US010987558B1

(12) United States Patent
Isgar

(10) Patent No.: US 10,987,558 B1
(45) **Date of Patent: *Apr. 27, 2021**

(54) CUSTOM GRIP

(71) Applicant: Charles Isgar, Scottsdale, AZ (US)

(72) Inventor: Charles Isgar, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/566,120

(22) Filed: Sep. 10, 2019

Related U.S. Application Data

(63) Continuation-in-part of application No. 16/381,785, filed on Apr. 11, 2019, now Pat. No. 10,589,156, which is a continuation of application No. 16/014,997, filed on Jun. 21, 2018, now Pat. No. 10,300,359.

(60) Provisional application No. 62/618,906, filed on Jan. 18, 2018.

(51) Int. Cl.

| | |
|---|---|
| ***A63B 53/14*** | (2015.01) |
| ***A63B 60/22*** | (2015.01) |
| ***A63B 60/32*** | (2015.01) |
| ***A63B 53/00*** | (2015.01) |
| *A63B 60/30* | (2015.01) |
| *A63B 60/26* | (2015.01) |
| *A63B 60/10* | (2015.01) |

(52) U.S. Cl.
CPC ..... *A63B 60/22* (2015.10); *A63B 53/007* (2013.01); *A63B 53/14* (2013.01); *A63B 60/32* (2015.10); *A63B 60/10* (2015.10); *A63B 60/26* (2015.10); *A63B 60/30* (2015.10)

(58) Field of Classification Search
CPC ..... A63B 60/22; A63B 60/26; A63B 60/10; A63B 60/30; A63B 60/32; A63B 53/16; A63B 53/14; A63B 53/007; A63B 2053/022
USPC ..... 473/313, 300, 302, 303
See application file for complete search history.

(56) References Cited

U.S. PATENT DOCUMENTS

| | | | | |
|---|---|---|---|---|
| 2,225,839 | A | 12/1940 | Moore, Jr. | |
| 3,804,413 | A | 4/1974 | Hrivnak | |
| 3,834,714 | A | 9/1974 | Smolinski | |
| 5,586,946 | A * | 12/1996 | Haber | A63B 53/14 473/295 |
| 7,510,483 | B2 | 3/2009 | Tremulis et al. | |
| 8,944,929 | B1 | 2/2015 | Smith | |
| 10,300,359 | B1 | 5/2019 | Isgar | |
| 2001/0041626 | A1 | 11/2001 | Madelle | |

(Continued)

*Primary Examiner* — Benjamin Layno
(74) *Attorney, Agent, or Firm* — Schmeiser, Olsen & Watts LLP

(57) ABSTRACT

Provided is an adjustable custom grip and method of forming the same are provided. The method of forming a customized putter grip includes orienting a first grip member having a first contact surface and a second grip member having a second contact surface of the customized putter grip in a predetermined orientation selected from a set of angles between the first contact surface and the second contact surface. The method may also include fixing the first grip member and the second grip member in the predetermined orientation. The method may further include coupling the customized putter grip with fixed first grip member and second grip member to a shaft of a putter. The custom grip provides for an anatomically, ergonomically custom putter grip to accommodate variations in human hands and other anatomical parts that affect the holding of a golf club grip.

5 Claims, 8 Drawing Sheets

(56) References Cited

U.S. PATENT DOCUMENTS

| | | | | |
|---|---|---|---|---|
| 2003/0036436 | A1 | 2/2003 | Casanova, Jr. et al. | |
| 2005/0079924 | A1* | 4/2005 | Heinecke | A63B 53/14 473/300 |
| 2005/0197201 | A1 | 9/2005 | Schoeninger | |
| 2006/0094525 | A1* | 5/2006 | Hung | A63B 53/14 473/300 |
| 2007/0079914 | A1 | 4/2007 | Larson | |
| 2008/0200288 | A1 | 8/2008 | Phelan | |
| 2010/0041489 | A1* | 2/2010 | Elmer | A63B 53/047 473/282 |
| 2010/0151975 | A1 | 6/2010 | Hisle et al. | |
| 2011/0224012 | A1 | 9/2011 | Hashimoto et al. | |
| 2014/0066221 | A1* | 3/2014 | Chen | A63B 60/14 473/299 |
| 2016/0287956 | A1 | 10/2016 | Wang | |
| 2017/0151475 | A1 | 6/2017 | Krouse | |
| 2018/0117432 | A1 | 5/2018 | Aliberti et al. | |
| 2020/0023252 | A1* | 1/2020 | Zmuda | A63B 60/12 |

* cited by examiner

CUSTOM GRIP

CROSS REFERENCE TO RELATED APPLICATION[S]

This application is a continuation-in-part of U.S. patent application entitled "ADJUSTABLE GRIP," Ser. No. 16/381,785, filed Apr. 11, 2019, now U.S. Pat. No. 10,589,156, which is a continuation of U.S. patent application entitled "ADJUSTABLE PUTTER GRIP," Ser. No. 16/014,997, filed Jun. 21, 2018, now U.S. Pat. No. 10,300,359, which claims priority to U.S. Provisional Patent Application entitled "PUTTER GRIP," Ser. No. 62/618,906, filed Jan. 18, 2018, the disclosure of which is hereby incorporated entirely herein by reference.

BACKGROUND OF THE INVENTION

Technical Field

This invention relates generally to a golf putter grip and more particularly to a putter with a custom grip.

State of the Art

There are numerous types of grips that can be installed on a putter. While conventional putter grips have different sizes and shapes, they are all maintained in a fixed position on the shaft of a putter requiring a fixed parallel grip. These conventional putter grips do not allow for any modification to the grip to adjust for anatomical variances by having variable grip positions that are more natural to enable the golfer to have a more comfortable and better swing of the putter. With these conventional putter grips, the golfer must adjust his or her holding of the straight putter grip without being able to accommodate their unique hand angle orientation.

Accordingly, there is a need for an improved putter grip that is adjustable to account for anatomical variances in golfers.

SUMMARY OF THE INVENTION

The present invention relates to an adjustable custom grip for a putter or other golf club. This invention allows the golfer to obtain a grip with an orientation of first and second grip portions to account for anatomical variations in human arms, wrists and hands.

An embodiment includes a method of forming a customized golf club grip may comprise orienting a first grip member having a first contact surface, and a second grip member having a second contact surface, of the customized golf club grip in a predetermined orientation selected from a set of angles between the first contact surface and the second contact surface; fixing the first grip member and the second grip member in the predetermined orientation; and coupling the customized golf club grip with fixed first grip member and second grip member to a shaft of a golf club.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to an adjustable putter grip for adjusting grip position. This invention allows each hand to have a different orientation to the putter shaft. Splitting of the grip allows changing the orientation of the hands. The invention further provides for an anatomically, ergonomically adjustable custom putter grip. Variability of grip accommodates all human hands.

Figure 1:
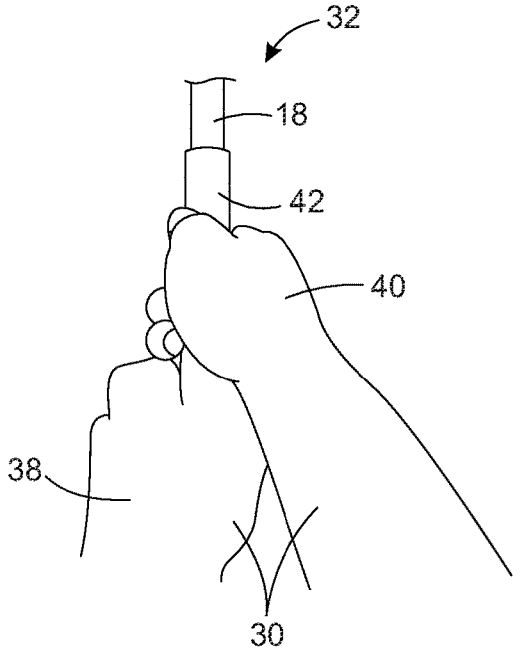
FIG. 1 is a perspective view of a neutral grip position of a golfer's hands on a putter grip according to an embodiment.
Figure 2:
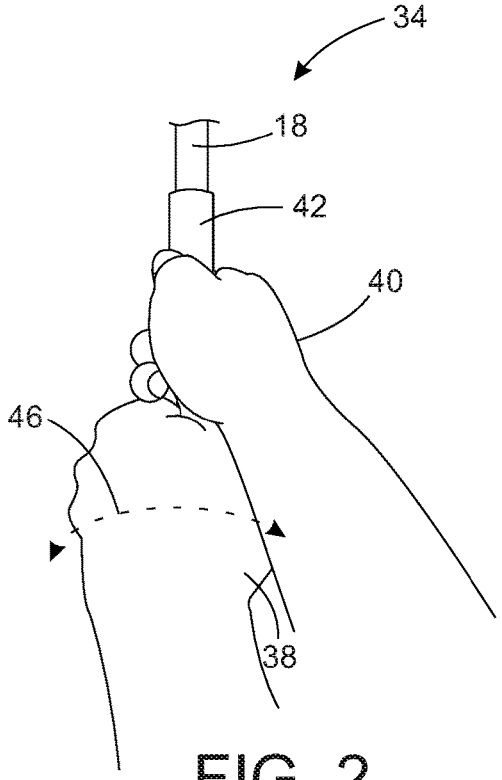
FIG. 2 is a perspective view of a grip position of a golfer's hands on a putter grip with the left hand pronated according to an embodiment.
Figure 3:
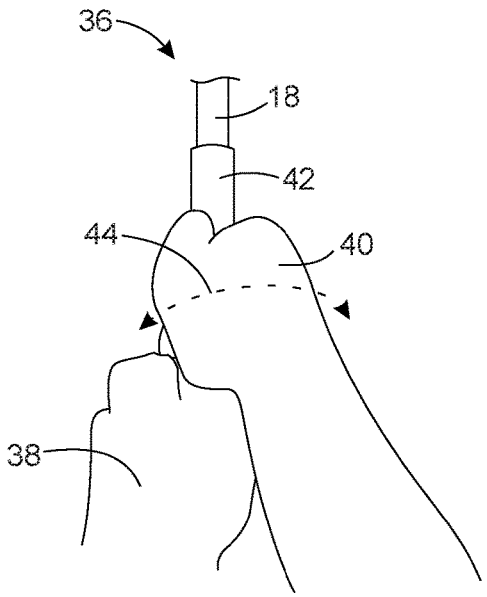
FIG. 3 is a perspective view of a grip position of a golfer's hands on a putter grip with the right hand pronated according to an embodiment.
Figure 4:
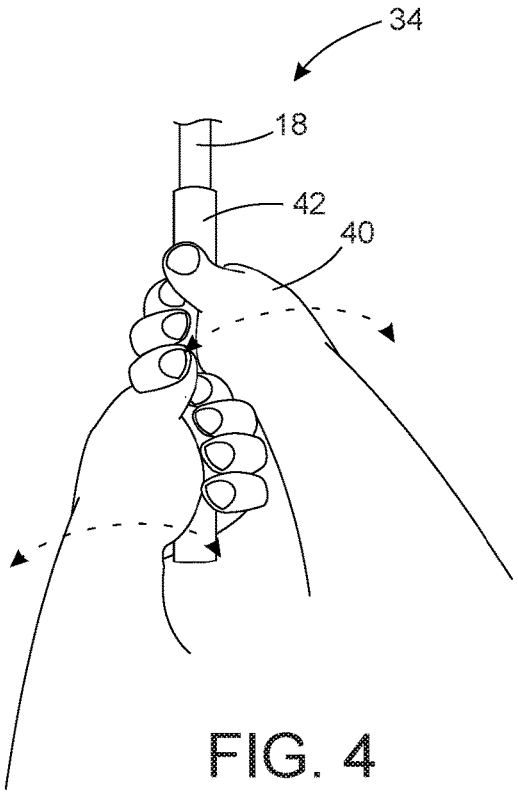
FIG. 4 is a perspective view of a grip position of a golfer's hands on a putter grip with the right and left hands supinated according to an embodiment.
Figure 5A:
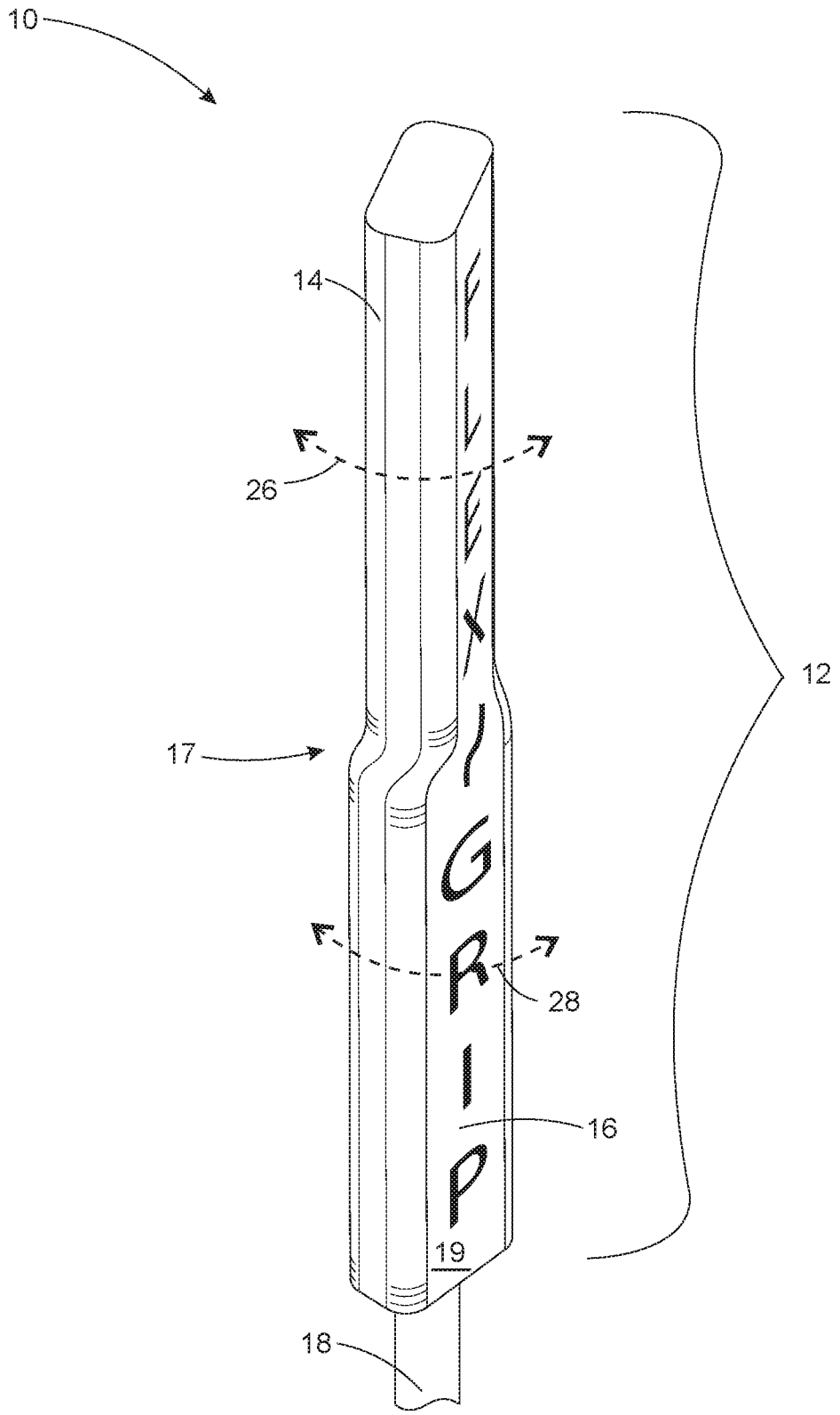
FIG. 5A is a perspective view of an adjustable putter grip according to an embodiment.
Figure 5B:
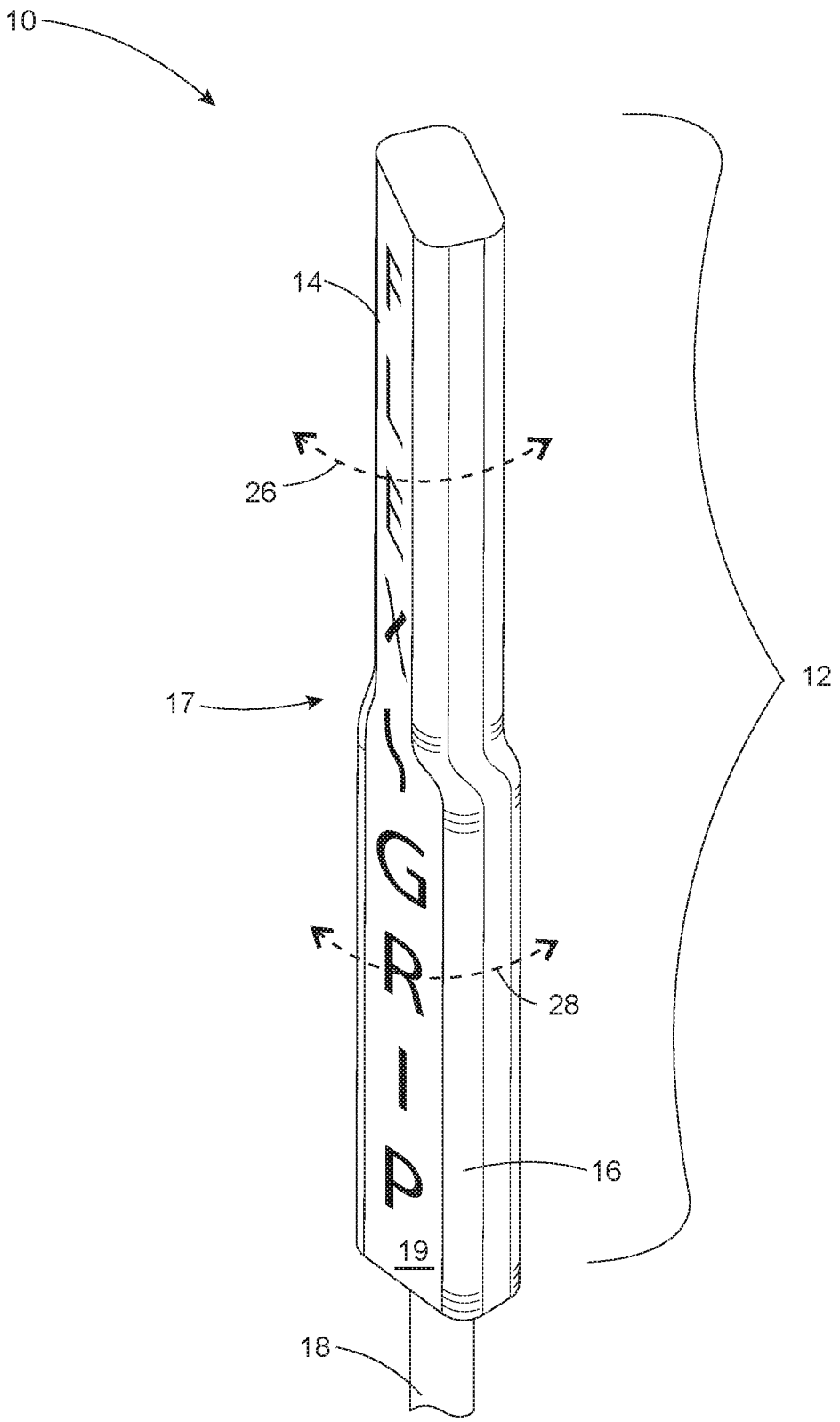
FIG. 5B is a perspective view of an adjustable putter grip according to an embodiment.
Figure 5C:
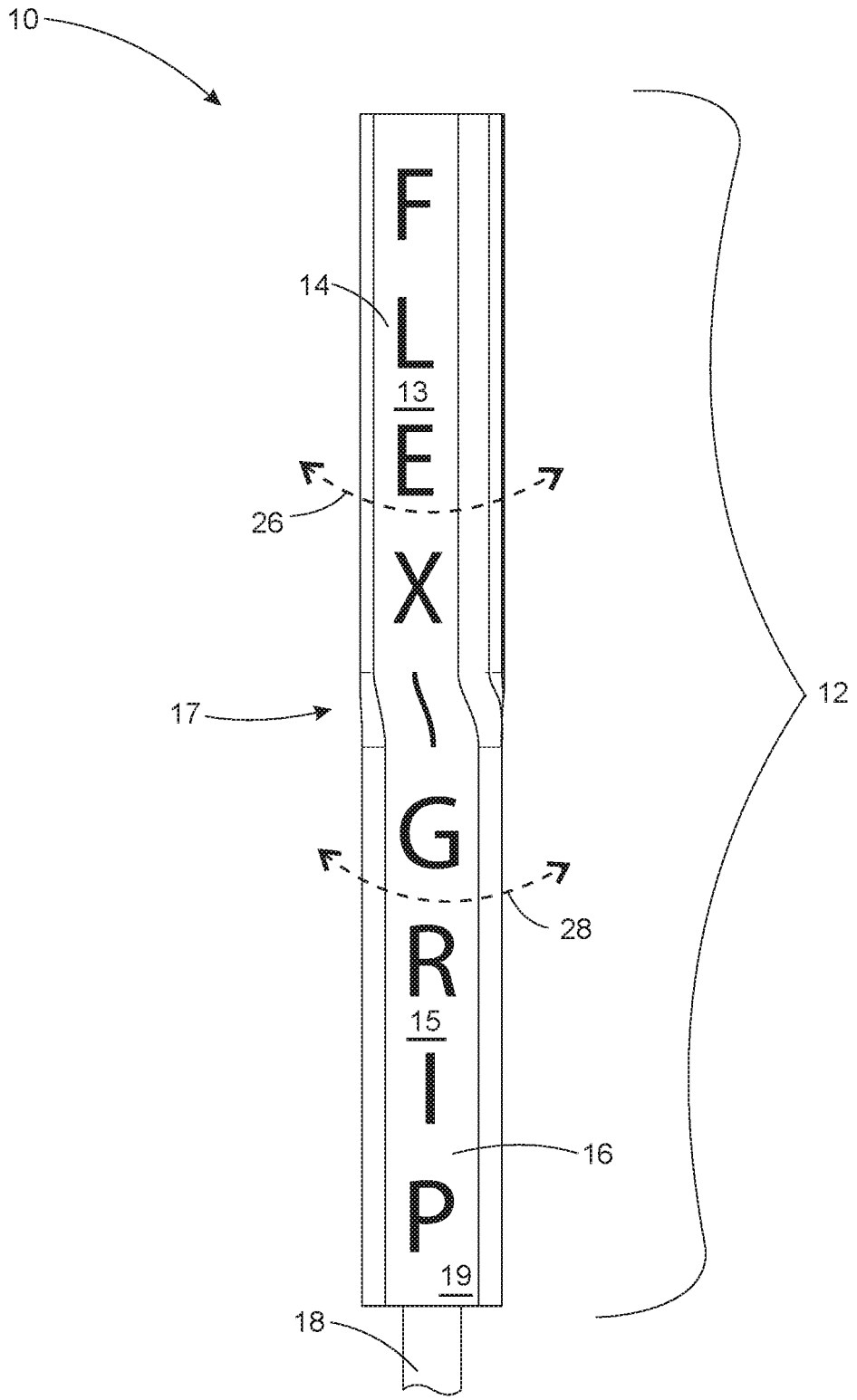
FIG. 5C is another perspective view of an adjustable putter grip according to an embodiment.
Figure 5D:
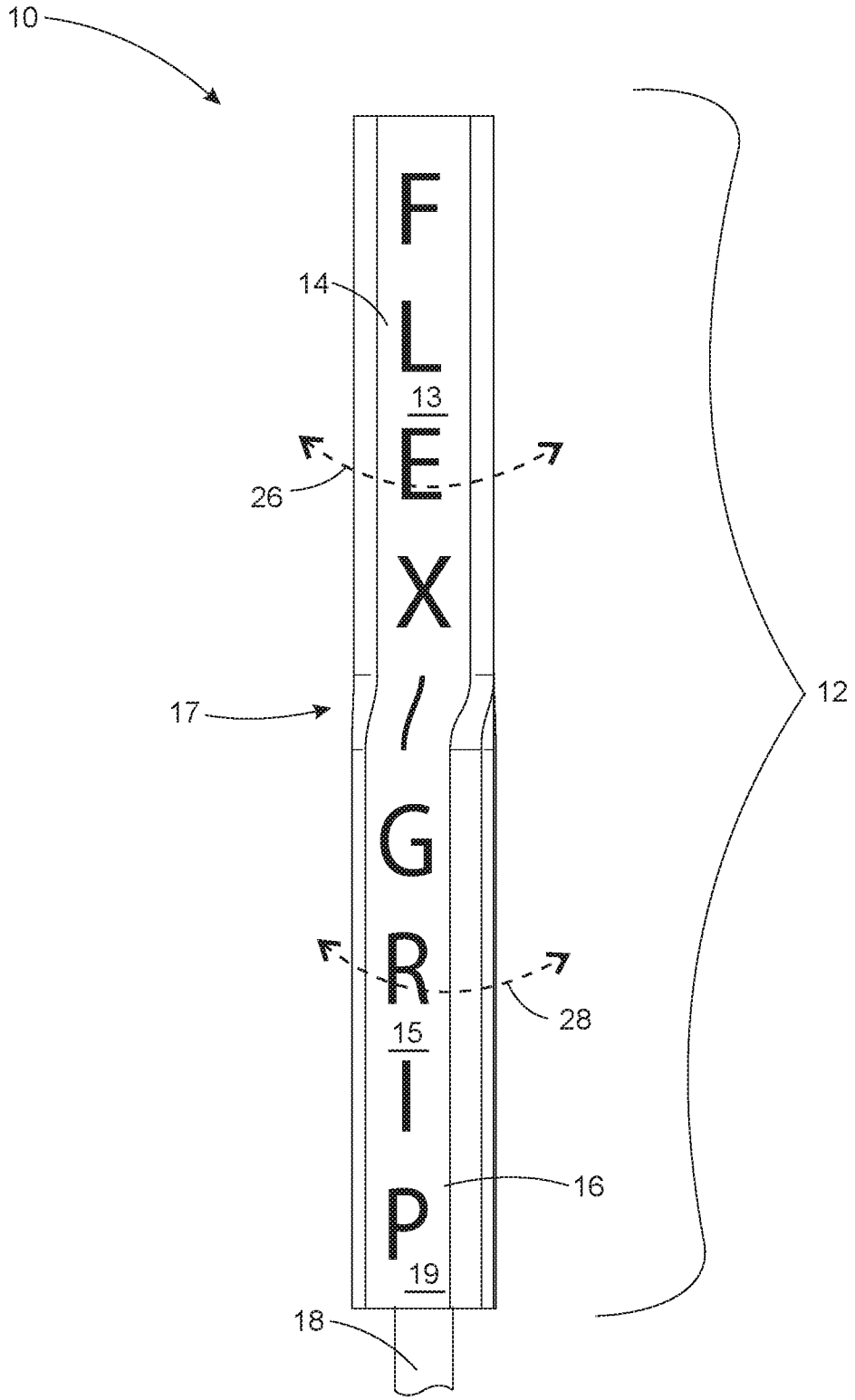
FIG. 5D is a further perspective view of an adjustable putter grip according to an embodiment.

In order to adjust grip position on a conventional putter grip, a golfer needs to rotate his or her hand to a different position on the putter grip, resulting in the palm, or other parts of the hand, to be removed or lack proper contact with the putter grip. For example, FIG. 1 is a top perspective view of a typical neutral grip position of a golfer's hands on a putter grip. FIG. 2 illustrates a grip position of a golfer's hands on a putter grip, wherein the left hand is pronated in a clockwise direction with respect to the right hand held in a neutral position. It will be understood that, as shown in FIG. 2, the left hand may be pronated or supinated with the right hand held neutral. FIG. 3 illustrates a grip position of a golfer's hands on a putter grip, wherein the right hand is pronated in a counterclockwise direction with respect to the left hand held in a neutral position. It will be understood that, as shown in FIG. 3, the right hand may be pronated or supinated with left hand held neutral. FIG. 4 depicts another grip wherein the grip is customized for the golfer by the right and left hands having the ability to be independently pronated and supinated in order to account for anatomical variances of different golfers. The above examples are not intended to be limiting as to the possible grip positions and orientations of a golfer's hands on a putter grip.

In embodiments, the grip members can move independently around the shaft. Grip members may also not move at all, wherein the manufacturer may apply the grip members to the shaft at the desired orientations.

According to embodiments, as shown in FIGS. 5A-5D, an adjustable custom grip is created using a method of forming a custom grip. A method of forming a customized putter grip may comprise orienting a first grip member having a first contact surface, and a second grip member having a second contact surface of the customized putter grip in a predetermined orientation selected from a set of angles between the first contact surface and the second contact surface; fixing the first grip member and the second grip member in the predetermined orientation; and coupling the customized putter grip with the fixed first grip member and the second grip member to a shaft of a putter.

The method may include independently pronating or supinating a first member and/or a second member of a putter grip in a desired orientation of the first member with respect to the second member for holding by a golfer's hands; forming a customized single unitary grip corresponding to the desired position of the first member with respect to the second member; and coupling a customized grip in a fixed position on a shaft of a putter. In at least this way, embodiments of the invention may be used for custom adjustments or fitting.

Independently pronating and supinating portions of the putter grip may include one of the golfer rotating a first member 14 having a first contact surface 13 and a second member 16 having a second contact surface 15 of the putter grip 12 in any direction displayed by arrows 26 and 28 respectively, with a twist point 17 located between the first and second members 14 and 16 (see FIGS. 5A-5B); the golfer rotating a first member 14 in any direction, displayed by arrow 26, while a second member 16 is held in a neutral position, with a twist point 17 located between the first and second members 14 and 16 (see FIG. 5C); or the golfer rotating a second member 16 in any direction, displayed by arrow 28, while a first member 14 is held in a neutral position, with a twist point 17 located between the first and second members 14 and 16 (see FIG. 5D), such that the first and second members of the grip 12 are positioned in a golfer-determined position at customized angles of rotation, the angles of rotation being measured as the angles between the first contact surface 13 and the second contact surface 15. It will be understood that the first and second contact surfaces 13 and 15 are surfaces that a golfer typically contacts with a thumb of the hand. The method of forming the custom grip 12 may include storing a plurality of angles of orientation between the first and second contact surfaces 13 and 15 in response to golfers pronating and/or supinating the first grip member 14 and the second grip member 16 into different angles. The method may also include accounting for the highest incidents of a same angle of orientation of the plurality of angles of orientation. The forming of the custom grip may include forming the custom grip with angles between the first and second members 14 and 16 that are the highest incidents.

The putter grip 12 may include a unitary grip cover 19 with malleable material interior to the unitary grip cover 19 to form the first and second grip members 14 and 16. Once the manufacturer determines the angles of the first and second putter grip members 14 and 16 and forms the custom grip, the custom grip 12 may be formed, set or otherwise secured in the defined position as a way of forming the customized grip.

Figure 6C:
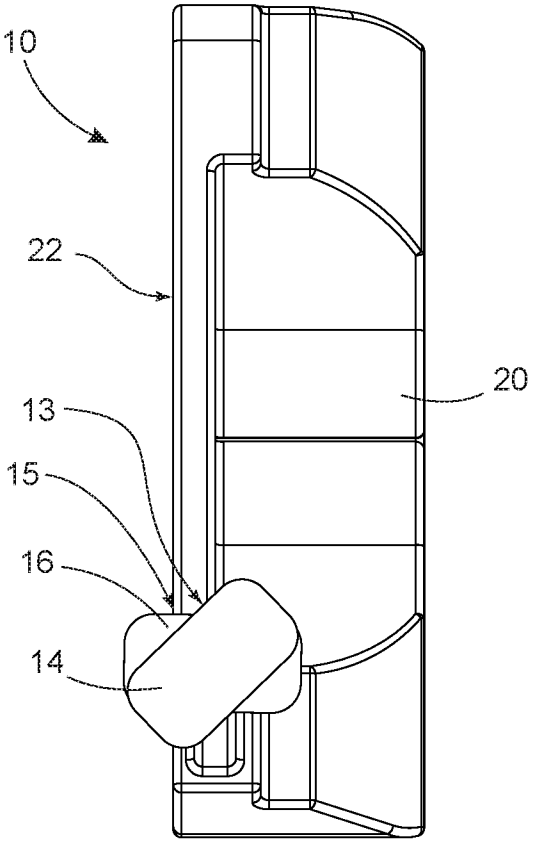
FIG. 6C is yet another top view of a putter with an adjustable putter grip in a third position according to an embodiment.
Figure 6B:
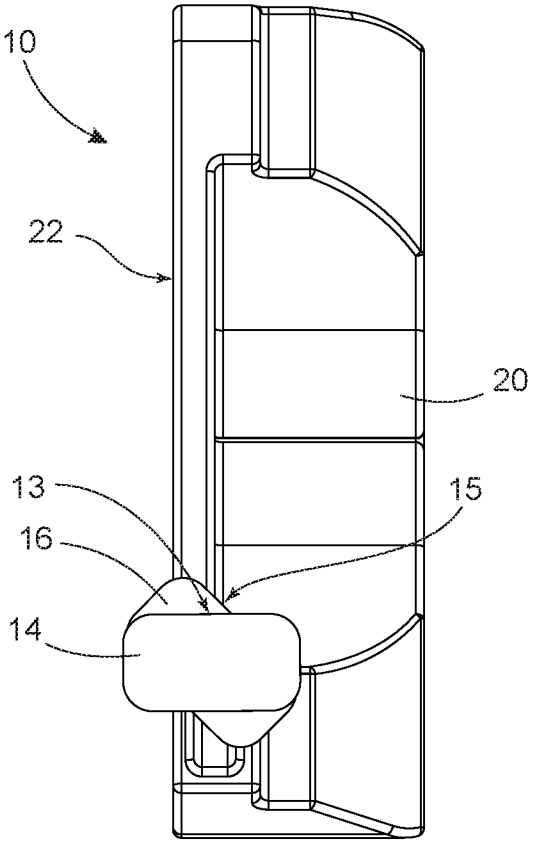
FIG. 6B is a top view of a putter with an adjustable putter grip in a second position according to an embodiment.
Figure 6A:
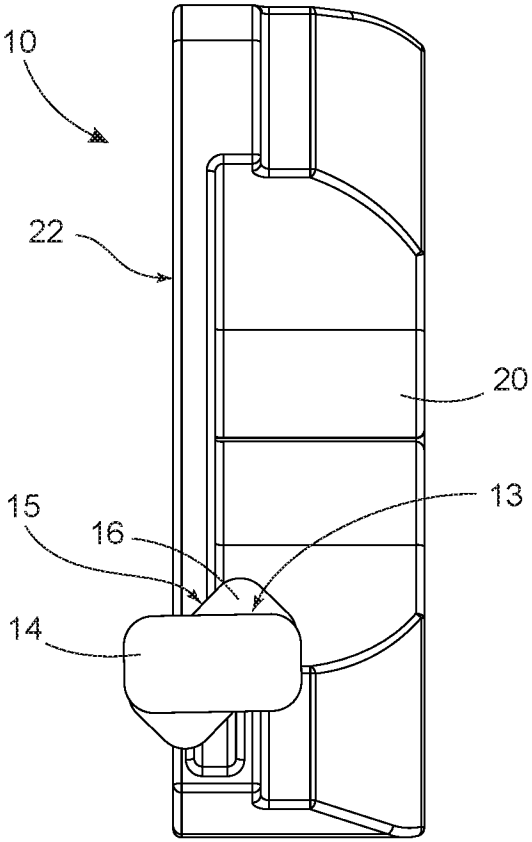
FIG. 6A is a top view of a putter with an adjustable putter grip in a first position according to an embodiment.
Figure 6F:
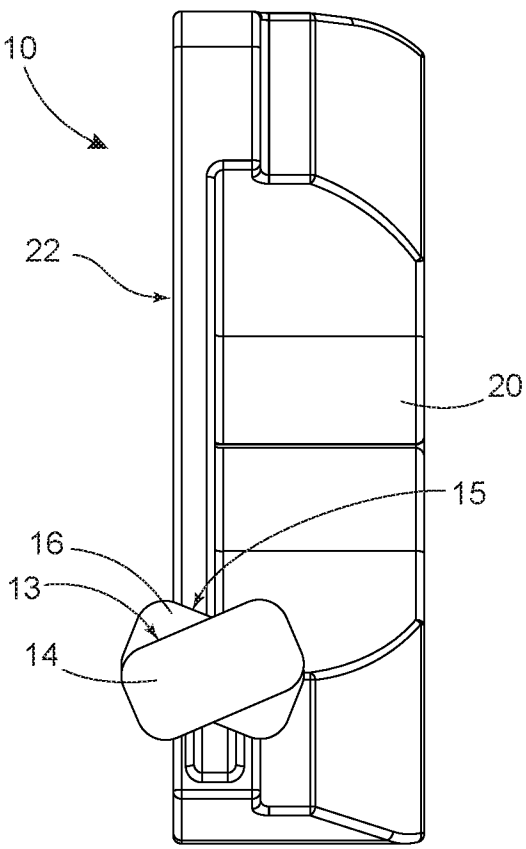
FIG. 6F is yet another top view of a putter with an adjustable putter grip in a sixth position according to an embodiment.
Figure 6E:
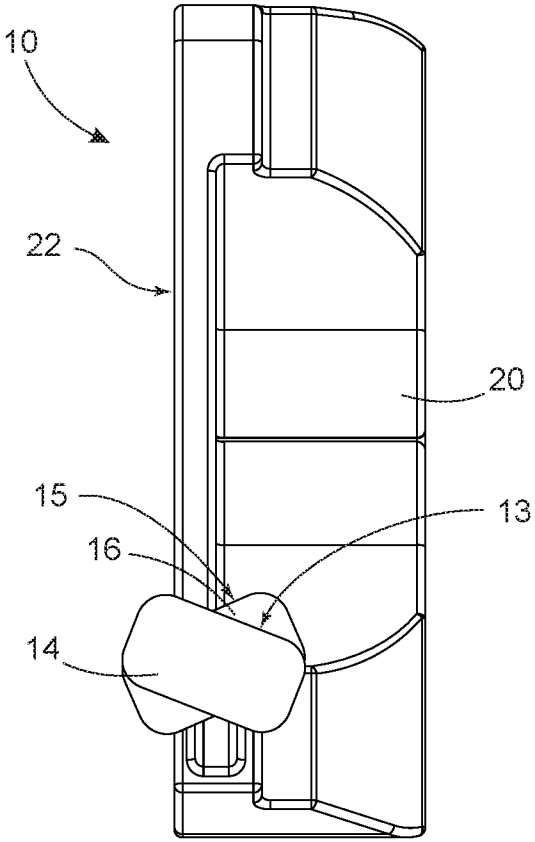
FIG. 6E is another top view of a putter with an adjustable putter grip in a fifth position according to an embodiment.
Figure 6D:
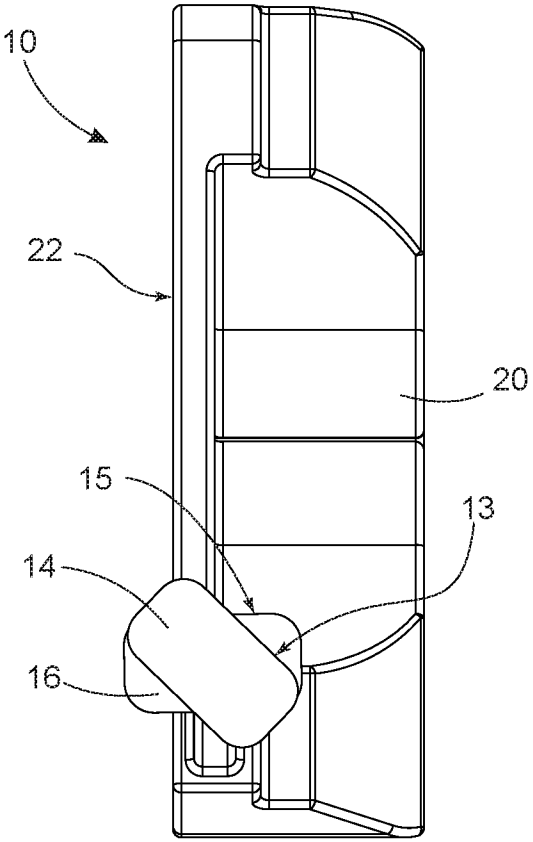
FIG. 6D is a top view of a putter with an adjustable putter grip in a fourth position according to an embodiment.

Referring further to the drawings, FIGS. 6A-6F depict various ways that the custom grip may be coupled to a golf club, such as a putter. It should be appreciated that the angles of rotation of the first and second grip members 14 and 16 are exaggerated in order to depict clearly the functionality of the present invention. In FIGS. 6A-6B the first grip member 14 has the first contact surface 13 substantially perpendicular to the face 22 of the putter 20 with the second contact surface 15 at an angle to both the first contact surface 13 and the face 22 of the putter 20. In FIG. 6C-6D the second grip member 14 has the second contact surface 15 substantially perpendicular to the face 22 of the putter 20 with the first contact surface 13 at an angle to both the second contact surface 15 and the face 22 of the putter 20. In FIG. 6E-6F the first grip member 14 has the first contact surface 13 at an angle with respect to the second contact surface 15, with first contact surface 13 and the second contact surface 15 at different angles with respect to the face 22 of the putter 20. These orientations of first grip member 14 to second grip member 16 and the orientation of the grip 10 coupled to the shaft of the putter are provided for exemplary purposes only and are not viewed as limitations to the invention.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description, as set forth, is not intended to be exhaustive or to limit the invention to the precise form disclosed. Many modifications and variations are possible, in light of the teachings above, without departing from the spirit and scope of the forthcoming claims.

The invention claimed is:

1. A method of forming a customized putter grip comprising:

orienting a first grip member, having a first contact surface, and a second grip member having a second contact surface, of the customized putter grip in a predetermined orientation, selected from a set of angles between the first contact surface and the second contact surface;

fixing the first grip member and the second grip member in the predetermined orientation;

coupling the customized putter grip with the fixed first grip member and the second grip member to a shaft of a golf club; and coupling the first grip member within a first portion of a unitary grip cover, and the second grip within a second portion of the unitary grip cover, wherein the first grip member and the second grip member are completely contained within the unitary grip cover.

2. The method of claim 1, further comprising storing a plurality of angles of orientation between the first and second contact surfaces in response to a plurality of golfers pronating and/or supinating the first grip member and the second grip member into golfer-determined orientations determined by angles between the first contact surface and the second contact surface.

3. The method of claim 2, further comprising accounting for highest incidents of a same angle of orientation of the plurality of angles of orientation of the first and second contact surfaces.

4. The method of claim 3, wherein the set of angles between the first contact surface and the second contact surface is formed from the highest incidents of a same angle of orientation of the plurality of angles of orientation of the first and second contact surfaces.

5. The method of claim 1, further comprising deforming the unitary grip cover in response to orienting the first grip member and the second grip member, wherein the first portion of the unitary grip member is oriented with respect to the second portion of the unitary grip member at an angle corresponding to the predetermined orientation between the first and second contact surfaces.

* * * * *